US011857859B2

(12) United States Patent
Dietrich

(10) Patent No.: US 11,857,859 B2
(45) Date of Patent: Jan. 2, 2024

(54) ADAPTIVE BASKETBALL SHOOTING DEVICES

(71) Applicant: Jonathan Dietrich, Franklin, ID (US)

(72) Inventor: Jonathan Dietrich, Franklin, ID (US)

( * ) Notice: Subject to any disclaimer, the term of this patent is extended or adjusted under 35 U.S.C. 154(b) by 311 days.

(21) Appl. No.: 16/943,514

(22) Filed: Jul. 30, 2020

(65) Prior Publication Data

US 2022/0032156 A1 Feb. 3, 2022

(51) Int. Cl.

| | |
|---|---|
| ***A63B 71/00*** | (2006.01) |
| ***A63B 69/00*** | (2006.01) |
| ***A63B 47/02*** | (2006.01) |
| ***A63B 69/40*** | (2006.01) |

(52) U.S. Cl.

CPC ..... *A63B 71/0009* (2013.01); *A63B 47/021* (2013.01); *A63B 69/0071* (2013.01); *A63B 69/406* (2013.01); *A63B 2071/0018* (2013.01); *A63B 2225/09* (2013.01)

(58) Field of Classification Search

CPC ..... A63B 71/0009; A63B 2071/0018; A63B 2071/0027; A63B 47/021; A63B 69/0071; A63B 69/406; A63B 2225/09; A63B 71/00

See application file for complete search history.

(56) References Cited

U.S. PATENT DOCUMENTS 1,198,300 A * 9/1916 Watkins ..... A63B 69/406 124/6
2,735,422 A * 2/1956 Jones ..... A63B 22/0694 601/36
3,306,613 A * 2/1967 Mainers ..... A63B 69/406 473/436
3,595,000 A * 7/1971 Recker ..... A01D 51/00 414/440
4,046,131 A * 9/1977 Clark ..... A63B 69/409 124/53.5
4,221,524 A * 9/1980 Morris ..... A63B 47/021 414/439
4,280,697 A * 7/1981 Yuasa ..... A63B 69/406 124/78

(Continued)

FOREIGN PATENT DOCUMENTS

GB 2279574 A * 1/1995 ..... A63B 69/407

OTHER PUBLICATIONS

GB-2279574-A (Year: 1993).*
Becker, Jenna, et al., "Adaptive Basketball Shooter Final Project Report," UPF Ballers, Jun. 10, 2014, pp. 1-139.

*Primary Examiner* — Melba Bumgarner
*Assistant Examiner* — Amir A Klayman
(74) *Attorney, Agent, or Firm* — Leber IP Law; Celia H. Leber

(57) ABSTRACT

Adaptive basketball shooting devices are disclosed that allow a person with limited use of his or her arms to shoot a basket from a seated position in a wheelchair. In preferred implementations, the device allows a person with limited mobility to pick up, carry, and shoot a basketball. Some devices include a frame, a conveyor configured to retrieve a ball from a surface on which the wheelchair is positioned, e.g., a floor or a paved basketball court, and in cooperation with the frame convey the ball vertically relative to the frame, and a driven wheel mounted on the frame and configured to eject the ball upward from the device.

17 Claims, 9 Drawing Sheets

(56) References Cited

U.S. PATENT DOCUMENTS 4,470,598 A * 9/1984 Steele ..... A63B 71/0009 473/56
4,753,449 A * 6/1988 Doucet ..... A63B 71/0009 D12/133
4,841,945 A * 6/1989 Braden ..... A63B 69/406 124/78
5,040,813 A * 8/1991 Cumbie ..... A61G 5/1054 297/162
5,417,196 A * 5/1995 Morrison ..... A63B 69/40 124/6
5,487,540 A * 1/1996 Bixler ..... A63B 69/40 473/436
6,079,930 A * 6/2000 Valdes-Rodriguez ..... A63B 47/021 414/440
6,227,981 B1 * 5/2001 Lizama Troncoso ..... A63B 71/0009 473/56
6,371,872 B1 * 4/2002 Daley ..... A63B 69/406 473/460
6,474,671 B1 * 11/2002 San Miguel Gomez ..... A61G 5/10 280/304.1
6,637,422 B2 * 10/2003 Wojtkiewicz ..... F41B 4/00 124/78
7,231,913 B2 * 6/2007 Wilson ..... A63B 69/406 124/78
7,708,003 B1 * 5/2010 Gavieres ..... A63B 47/002 124/78
8,123,634 B1 * 2/2012 Lovett ..... A63B 63/083 473/436
8,556,565 B2 * 10/2013 Reyes ..... A63B 47/021 414/439
8,602,711 B1 * 12/2013 Nash ..... A63B 47/021 414/440
9,022,016 B1 * 5/2015 Hafer ..... F41B 4/00 124/78
9,301,503 B1 * 4/2016 Arrighi ..... F41B 4/00
9,302,165 B2 * 4/2016 Chu ..... D04B 21/10
9,623,313 B1 * 4/2017 Boehner ..... A63B 69/406
9,782,638 B2 * 10/2017 Kim ..... A63B 69/406
9,827,476 B2 * 11/2017 Giner Gil ..... A63B 71/00
10,188,929 B2 * 1/2019 Kabes ..... A63B 21/0552
10,881,940 B1 * 1/2021 Ye ..... A63B 69/406
2012/0004054 A1 * 1/2012 McKendrick ..... A63B 69/0075 473/417
2014/0109887 A1 * 4/2014 Edson ..... A63B 47/04 124/78
2017/0266516 A1 * 9/2017 Askenazi ..... A63B 47/02
2018/0272197 A1 * 9/2018 Askenazi ..... A63B 47/02

* cited by examiner

ADAPTIVE BASKETBALL SHOOTING DEVICES

BACKGROUND

Wheelchair basketball is a very popular adaptive sport. However, at present participation in wheelchair basketball generally requires that the adaptive athlete have at least some use of his or her arms. If an individual's arm strength or control is very limited it can be difficult or impossible to retrieve a basketball from the floor of the court and shoot a basketball. Some attempts have been made to address this issue, but there remains a need for a safe, easy to use device that can be made widely available to disabled athletes and that can be utilized with very little or no arm strength/control.

SUMMARY

The present disclosure features adaptive basketball shooting devices that allow a person with limited use of his or her arms to shoot a basket from a seated position in a wheelchair. In preferred implementations, the device allows a person with limited mobility to pick up, carry, and shoot a basketball. In some cases, the device is configured to be used to shoot the basketball from approximately 12 to 50 feet from the basket, while in other implementations a wider range of from approximately 2 to 100 feet is possible.

In one aspect, the disclosure features a device that includes a frame, a conveyor configured to retrieve a ball from a surface on which the wheelchair is positioned, e.g., a floor or a paved basketball court, and in cooperation with the frame convey the ball vertically relative to the frame, and a driven wheel mounted on the frame and configured to eject the ball upward from the device.

Some implementations include one or more of the following features. The conveyor system may include lower guide rails configured to guide vertical movement of the ball within the frame. The conveyor system may further include a conveyor belt positioned opposite the lower guide rails such that the ball is interposed between a contact surface of the conveyor belt and the contact surfaces of the lower guide rails during vertical movement. The horizontal distance between the contact surface and the closest surface of the guide rails may be, for example, from about 7.5 to 9 inches. The contact surface of the conveyor belt is positioned relative to the contact surfaces of the lower guide rails so that pressure is applied to the ball during vertical movement. A lowermost surface of the conveyor belt may be positioned, for example, about 7.5 to 9.5 inches above a lowermost surface of the lower guide rails. The device may further include a member configured to deflect an upper region of the conveyor belt toward the lower guide rails to urge the ball upward into engagement with the shooter wheel system. The frame may include a platform that is configured to be attached via armrest supports of the wheelchair. The shooter wheel system may include a driven shooter wheel and a pair of opposed upper guide rails that define a shooter wheel track configured to guide release of the ball from the device. The horizontal distance between a contact surface of the shooter wheel and contact surfaces of the upper guide rails may be, for example, from about 7.5 to 9 inches. The upper guide rails may include arcuate contact surfaces. The device may further include a control system in electrical communication with a drive assembly for the conveyor system and a drive assembly for the shooter wheel system. The control system may include a user interface configured to allow the user to actuate the conveyor system and the shooter wheel system.

In another aspect, the disclosure features a method of shooting a basket from a wheelchair, comprising: (a) mounting a frame of an adaptive basketball shooting device on a wheelchair; (b) actuating a driven belt of the device to draw a ball into the frame; (c) using the driven belt to move the ball vertically within the frame; and (d) actuating a shooter wheel of the device to eject the ball from the frame.

Some implementations of the method may include one or more of the following features. The method may further include driving the wheelchair to a desired shooting position relative to a basket. Using the driven belt to move the ball vertically may include feeding the ball into contact with the shooter wheel. Actuating the driven belt and actuating the shooter wheel may be performed by a user of the wheelchair using controls on a control panel. The controls may include a switch that actuates the driven belt, a switch that actuates the shooter wheel, and a knob that allows the user to control the speed of the shooter wheel. The method may further include turning the driven belt off between the steps of actuating the driven belt and actuating the shooter wheel, wherein the device is configured to maintain the vertical position of the ball when the driven belt is turned off. The method may also include, prior to the step of actuating the driven belt, inflating a tire of the shooter wheel to a pressure of from about 5 to 20 psi.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

DETAILED DESCRIPTION

Figure 1:
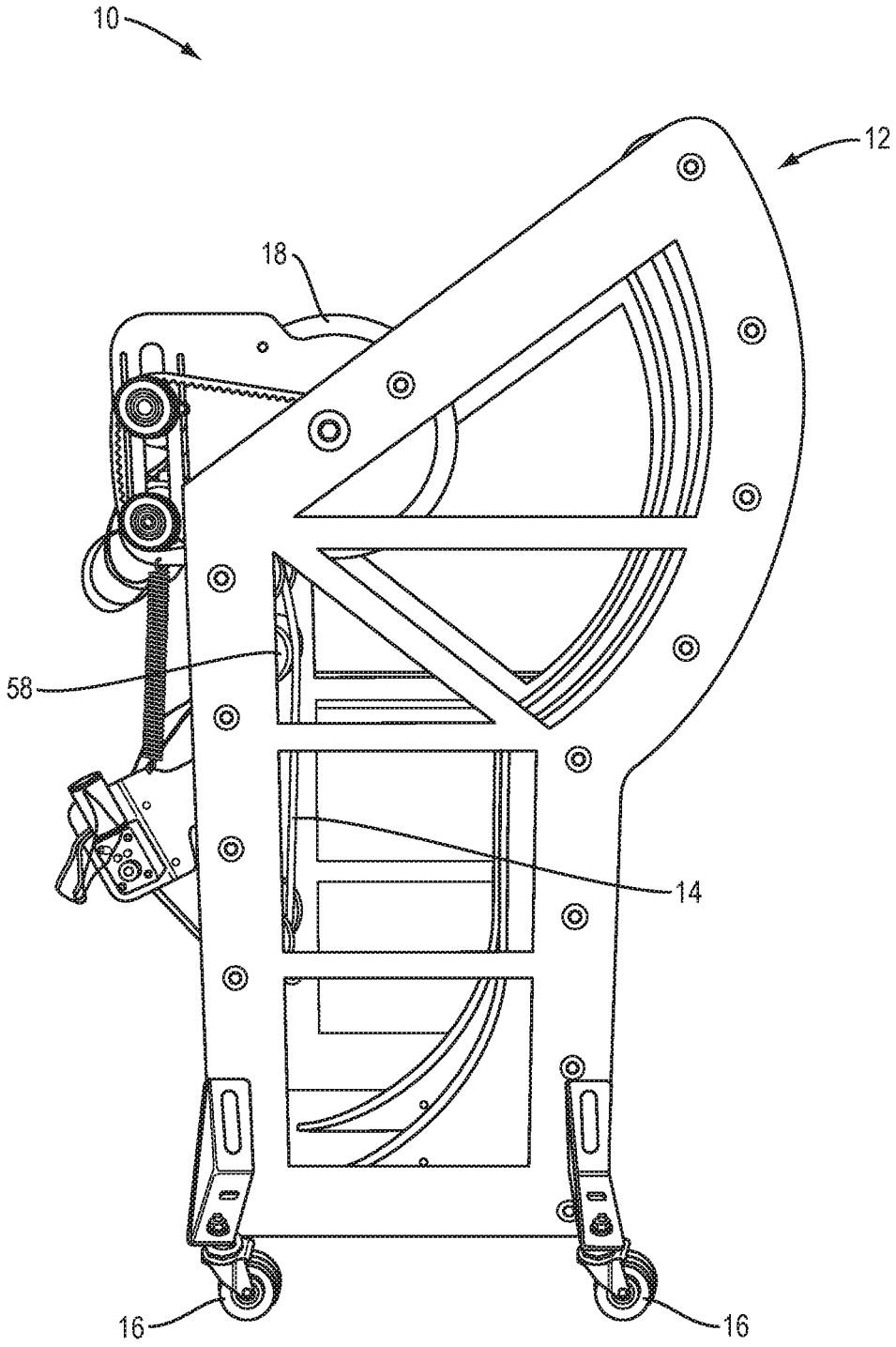
FIG. 1 is a side view of an adaptive basketball shooting device according to one implementation.
Figure 1A:
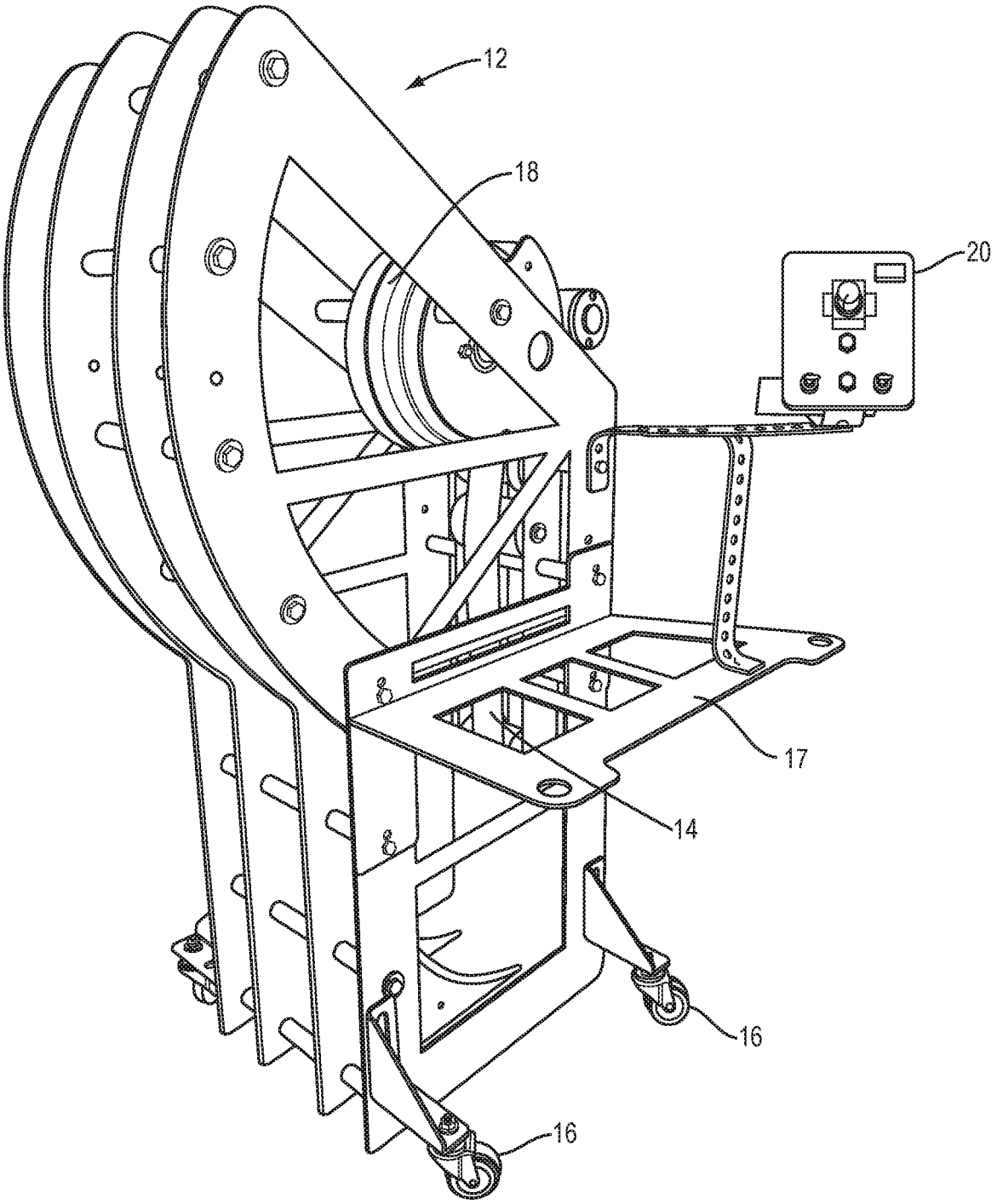
FIG. 1A is a perspective view of the shooting device.

Referring to FIGS. 1 and 1A, an adaptive basketball shooting device 10 according to one implementation includes an outer frame 12 and, within the frame, a conveyor belt 14 configured to be actuated by a user to retrieve a ball from a surface on which the wheelchair is positioned. The frame 12 is mounted on wheels 16, which support the weight of the device and allow smooth movement in any direction, and includes a platform 17 that is configured to be readily attached to a user's wheelchair. The wheels 16 minimize stress on the wheelchair and maintain fluid motion while moving across the court. The wheels also prevent the chair from leaning to one side or tipping, keeping the occupant safe, level and comfortable, and make it easier to attach the device 10 to a variety of chairs and transport the device when it is not mounted on a wheelchair. In the embodiment shown the device includes four wheels which all swivel and are made of a non-marking material to prevent scuffing of a court.

As will be discussed with reference to FIGS. 2-2B, a portion of the frame 12 defines a track that controls vertical motion of the ball by the conveyor belt 14 until the ball reaches a position where it can be engaged by a shooter wheel 18. The shooter wheel 18, in cooperation with an upper portion of the frame, is configured to eject the ball upward from the device when actuated by the user. A control panel 20 (FIG. 1A) is provided to allow the user to control operation of the conveyor belt and shooter wheel to shoot a basket. The conveyor belt, shooter wheel and controller may be powered by a portable power supply (not shown), e.g., a battery, that may be mounted on the platform 17 or otherwise attached to the frame 12 or, alternatively, by the power supply of a powered wheelchair. The various components of the device and the manner in which the device is used will be discussed in detail below.

Figure 2:
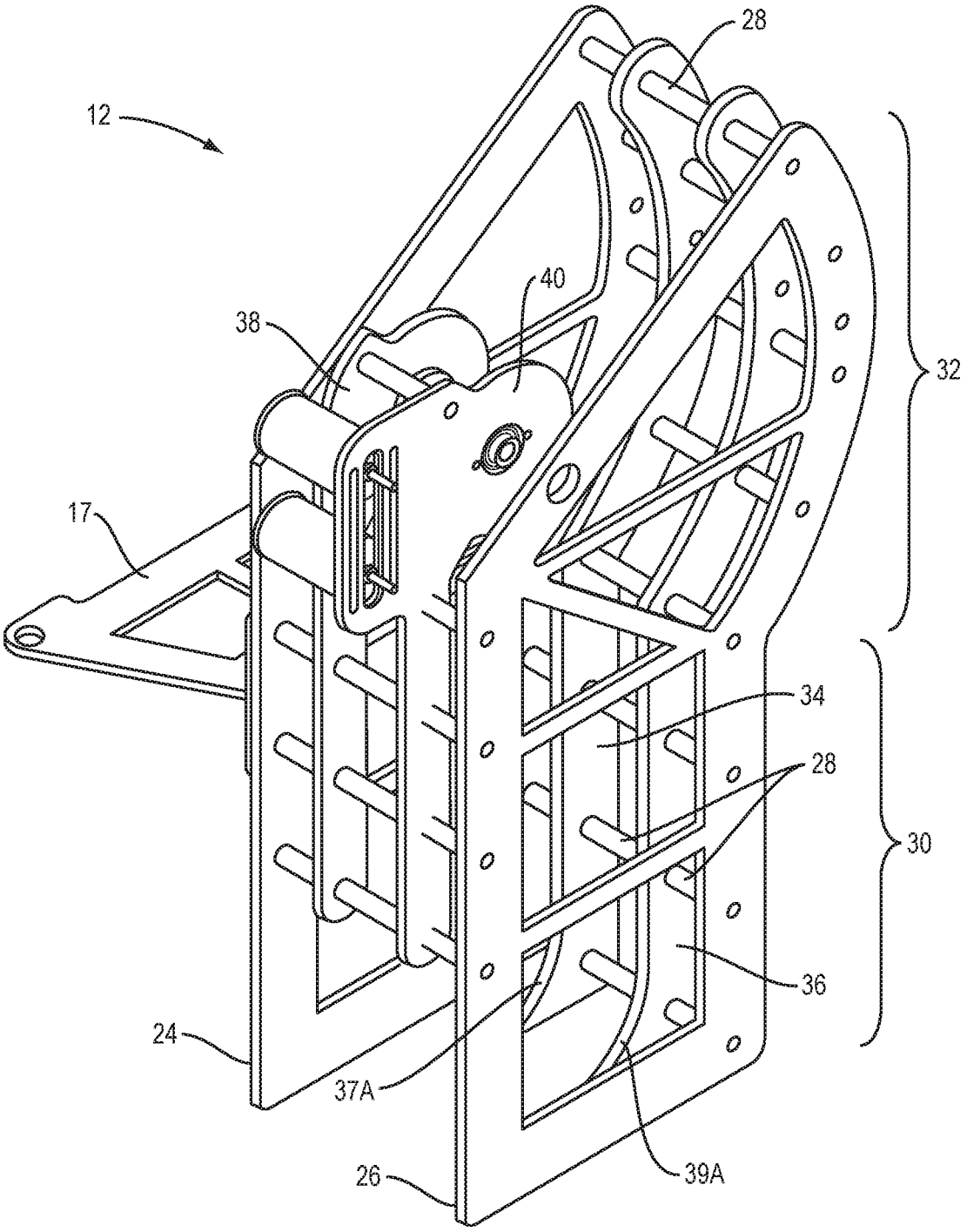
FIG. 2 is a perspective view of the frame and certain other components used in the device shown in FIG. 1.
Figure 2A:
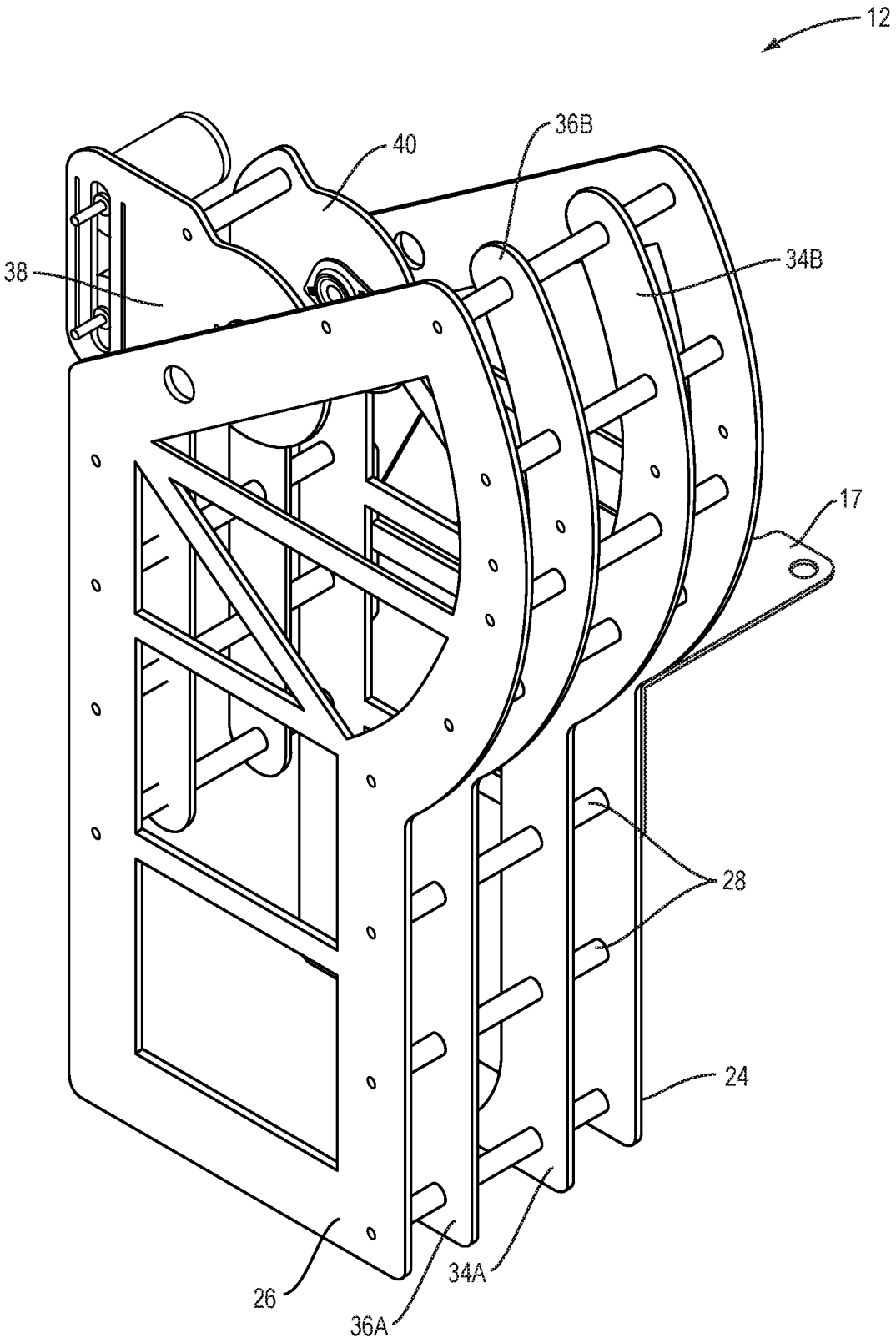
FIG. 2A is a perspective view similar to FIG. 2 but taken from a different angle.
Figure 2B:
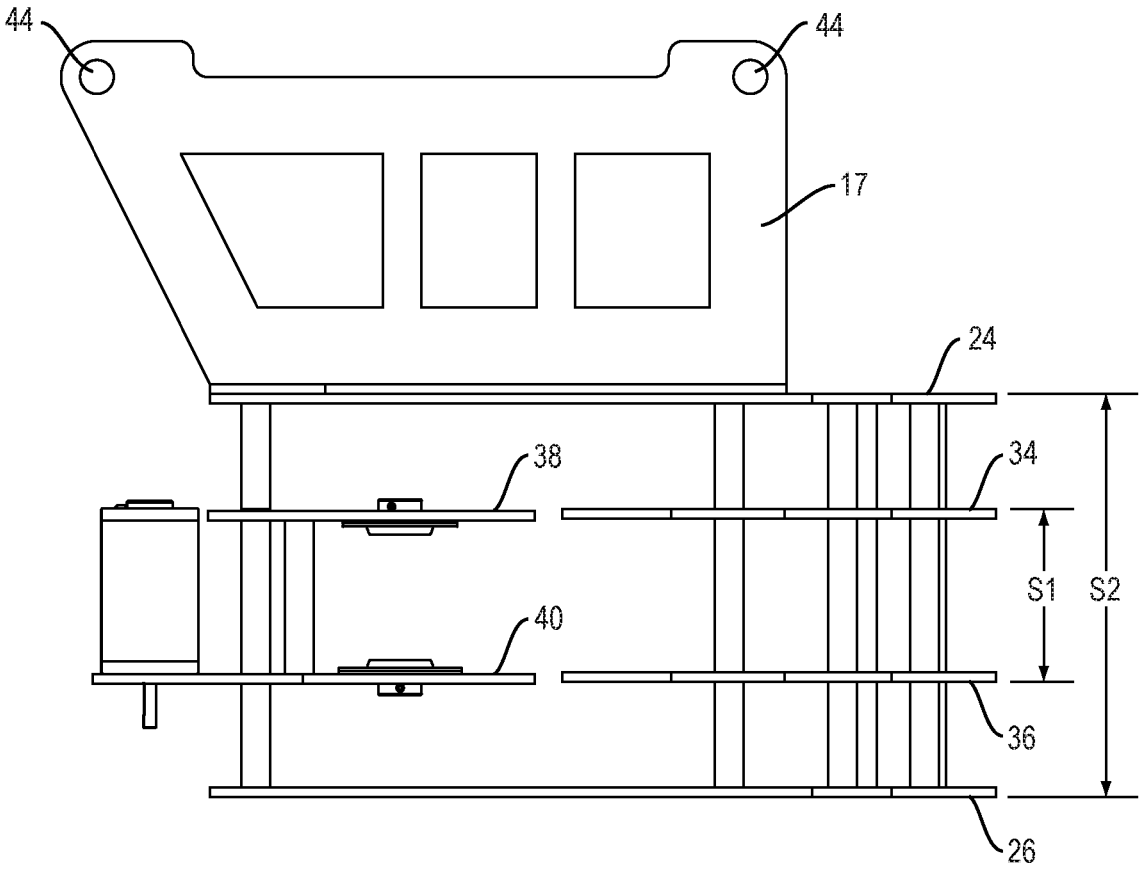
FIG. 2B is a top view of the frame and components shown in FIGS. 2-2A.
Figure 5:
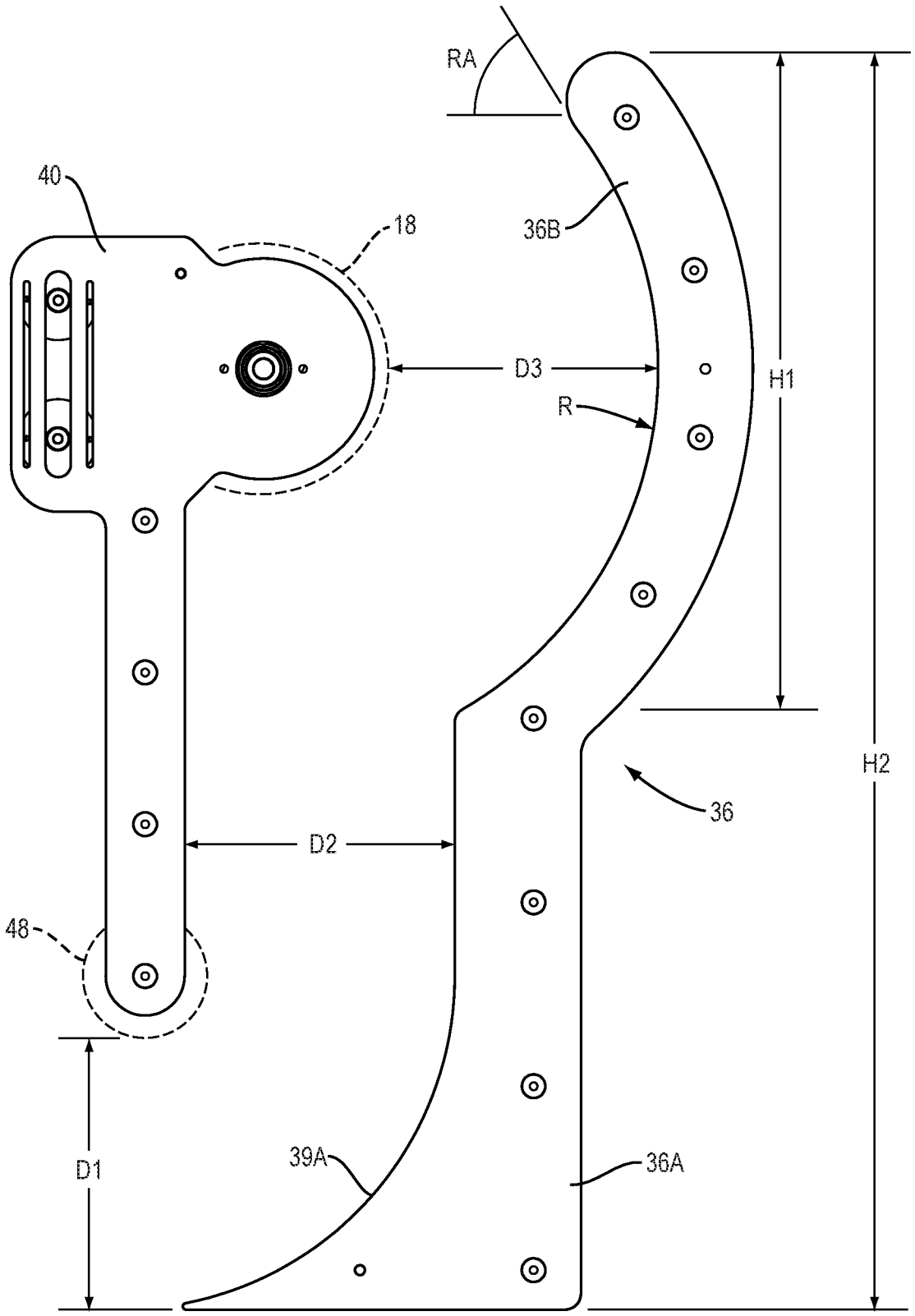
FIG. 5 is a partial diagrammatic side view of a laterally central area of the device of FIG. 1.

FIGS. 2-2B illustrate, from various angles, the frame 12 that is used in the shooting device shown in FIGS. 1-1A. Frame 12 is formed by two outer plates 24 and 26, which are connected by a plurality of connecting rods 28, and which together define a lower transport section 30 and an upper shooting section 32. Interposed between the outer plates and held in predetermined lateral positions by the rods 28 are a pair of inner rails 34 and 36. These rails act as guide rails, as will be discussed below, and have lower sections 34A, 36A (FIG. 2) that correspond to the lower transport section of the frame, and upper arcuate sections 34B, 36B that correspond to the upper shooting section of the frame. The lower sections 34A, 36A include arcuate surfaces 37A, 39A (best seen in FIGS. 2 and 5) that initiate contact between the ball and the lowermost surface of the conveyor belt 14 and help to guide the ball from the surface into contact with the conveyor belt. Referring to FIG. 5, the distance D1 from the lowermost surface of the wheel 48 that drives the conveyor belt 14 to the lower edge of the arcuate surfaces 37A, 39A is selected so that the conveyor belt 14 will contact the ball on the ground or floor with sufficient pressure to draw the ball up into the frame. For example, D1 may be from about 7.5 to 9.5 inches.

Frame 12 also includes a pair of parallel opposed support plates 38, 40 that support the shooter wheel, the drive system for the shooter wheel (shown in FIG. 4 and described below), and the wheels that drive and position the conveyor belt (shown in FIG. 3 and described below). As shown in FIG. 5, the spacing between the support plates 38, 40 and the opposed inner rails 34, 36, is selected so that the distance D2 between the conveyor belt surface and the opposed surfaces of lower sections 34A, 36A that contact the ball will be substantially equal to the distance D3 between the surface of the shooter wheel 18 and the opposed surfaces of upper sections 34B, 36B that contact the ball. If the device is to be used with a standard-sized basketball, D2 and D3 are between about 7.5 and 9 inches, for example between 8.25 inches and 8.5 inches. This spacing distance, which is less than the diameter of a standard-sized basketball (approximately 9.5 inches depending in inflation) ensures that sufficient pressure is applied between the conveyor belt and the inner rails 34, 36 to cause the ball to travel vertically within the frame. Distance D2 is also selected to apply sufficient pressure to the ball to hold the ball in a desired vertical positioning within the frame when the conveyor belt 14 is switched off during upward movement of the ball. This allows the user to use the conveyor to pick up the ball at a first location and then drive to a second location to shoot the ball with the ball securely held in place within the frame.

Referring to FIG. 2B, the spacing S1 between rails 34, 36 and the spacing S2 between outer plates 24 and 26 are also important. Spacing S1 is selected so that the rails will act as a track to guide the ball and is generally from about 3 to 5 inches for a standard-sized ball. Spacing S2 is selected to be approximately equal to the diameter of the ball (e.g., from about 9.5 inches to 11 inches), so that the ball will stay positioned against the conveyor belt and not have excessive lateral movement during its vertical travel through the frame.

The upper sections 34B, 36B define a shooter track that, in cooperation with the rotational force of the spinning shooter wheel 18, ejects the ball from the device. Referring to FIG. 5, the radius of curvature R of the inner surface of upper sections 34B, 36B, and the height H1 of the upper sections combine to define the angle at which the ball will be ejected from the device (the release angle). The radius of curvature R may be, for example, from about 10 to 14 inches from the center of the shooter wheel, for example from about 11.5 to 13.5 inches. The height H1 may be, for example, from about 16 to 26. The release angle RA is generally selected to be from about 40 to 80 degrees, for example from about 45 to 60 degrees. The overall height of the device, from the bottom of the frame to the highest point on the upper sections (height H2) is typically from about 16 to 36. This combination of dimensions allows a user to shoot a basketball from about a wide range of distances from the target, in some implementations from 2 to 100 feet away from the target, depending on the speed of the shooter wheel as selected by the user.

Platform 17, best seen in FIGS. 1A and 2B, is used to attach the device 10 to a user's wheelchair by removing the armrest of the wheelchair and passing the armrest supports through openings 42 and then replacing the armrest prior to use. The dimensions and configuration of platform 17 can be modified to adapt the device for attachment to various wheelchair models, or other attachment methods may be used. Platform 17 may also be used to support a battery (not shown) if one is needed to power the conveyor belt and shooter wheel.

Figure 3:
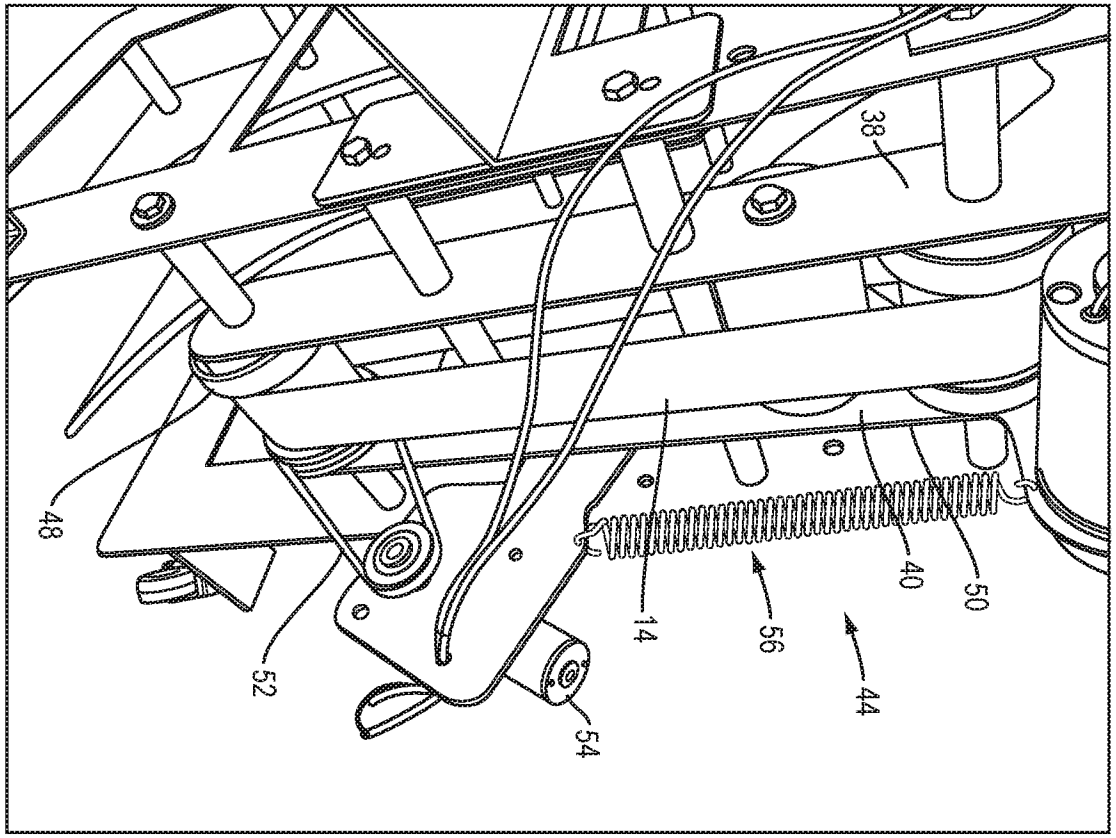
FIG. 3 is an enlarged perspective view of the conveyor belt system used in the shooting device of FIG. 1.

FIG. 3 provides a detailed view of the conveyor belt system 44. Conveyor belt system 44 includes the conveyor belt 14 discussed above, which may for example be made of polyurethane, a belt-driven lower wheel 48 and a non-driven upper wheel 50. Wheels 48 and 50 are mounted between support plates 38 and 40 discussed above. In some implementations, the material of the conveyor belt surface (the surface that contacts the ball) has a relatively high coefficient of friction to prevent slippage of the ball as it is conveyed upwards. However, in some implementations this is not necessary, for example if sufficient force is applied to the ball so that slippage is minimized.

The lower wheel 48 is driven by drive belt 52, which in turn is driven by a motor 54. Motor 54, which may be, for example, a 12V electric motor, is configured to be actuated by the user, as will be discussed below, and to run the conveyor belt at a speed of from about 20 to 40 ft/min. This belt speed range can be accomplished, for example, by having the motor spin at about 90 to 110 RPM and the drive roller spin at about 50 to 60 RPM. In the implementation shown, the drive belt 52 is tensioned by a spring tensioning assembly 56, however this can be accomplished by other belt tensioning techniques. The conveyor belt may be, for example, about 1 to 4 inches wide. If the belt is wider, the edges of the belt will not contact the ball, whereas if the belt is narrower it may not create enough friction to lift the ball.

A positioning roller 58, best seen in FIG. 1, is mounted between support plates 38, 40 just below the upper wheel 50. This positioning roller pushes the belt outward, towards the opposed surfaces of the rails 34, 36 near the transition between the lower sections of the rails and the upper arcuate sections, pushing the ball up into contact with the shooter wheel and shooter track. In some implementations, the positioning roller deflects the belt by about 0.25 to 0.75 inch. The contact length of the conveyor belt 14 is selected to lift the ball from the floor and convey it vertically to a point where the ball contacts the shooter wheel 18.

The length of belt 52 can be, e.g., about 24 to 36 inches, for example from about 30-32 inches. The contact length of the belt with the ball, i.e., the distance from the top of the upper roller to the bottom of the lower roller, can be, for example, about 14 to 18 inches. The contact length is generally selected to allow enough room for the ball to be held in the lower track until it is lifted into the shooter wheel.

Figure 4:
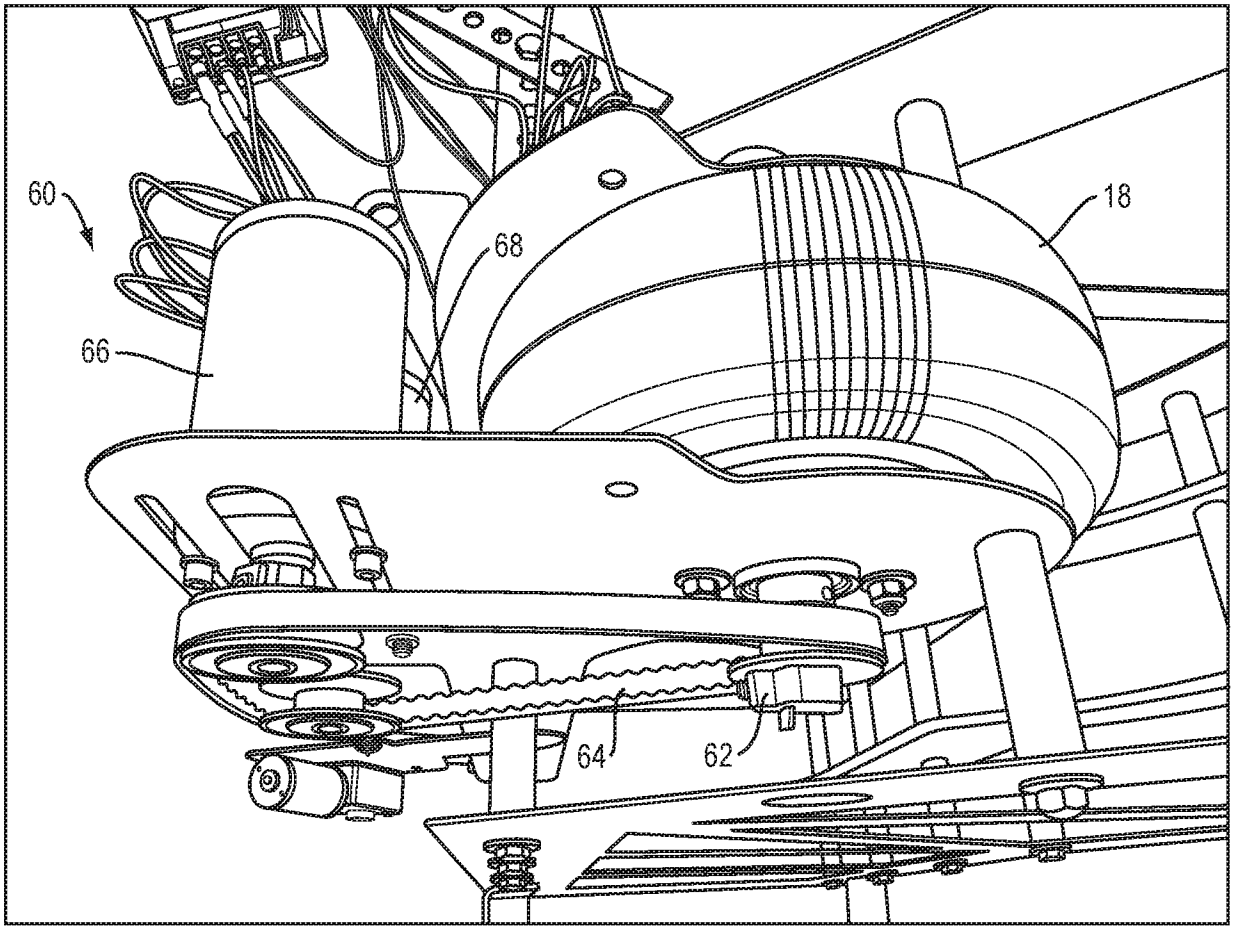
FIG. 4 is an enlarged perspective view of the shooter wheel system used in the shooting device of FIG. 1.

The shooter wheel system 60 is shown in detail in FIG. 4. Shooter wheel system 60 includes the shooter wheel 18, a shaft 62 on which the shooter wheel is mounted, a belt 64 to drive the shooter wheel, and a pair of motors 66, 68 to drive the belt 64. The motors may be, for example, 12V electric motors. The speed of the motors is adjustable by the user, allowing the user to shoot the ball from the device at a desired velocity. For example, the speed of the motors can be adjusted between about 100 and 4000 RPM, e.g., from about 1000 and 3500 RPM.

The shooter wheel 18 has a tire that is configured to grip the ball during shooting. The better the grip, the more efficient the shooter will be and the less chance there will be that slippage between the ball and tire will occur during shooting. The grip provided by the tire is dependent on the material of the tire, which is preferably relatively soft and tacky, and the tire pressure. Preferably the tire is inflated to a relatively low pressure, e.g., between 5 and 20 psi. The tire pressure is important because it affects the pressure between the ball and the inner rails. With that being said, the contact between the shooter wheel and rails is affected by both the air pressure of the tire and the air pressure of the ball. The shooter wheel diameter is important because it affects the amount of time when the ball is directly contacting the wheel. In some implementations the shooter wheel is from about 6 to 12 inches in diameter. If it is too small, there will not be enough contact. If too large, it will become bulky and add more weight than necessary. The shooter wheel diameter also affects the motors and how strong they need to be in order to spin the wheel fast enough.

As discussed above with reference to FIG. 1A, the device 10 includes a control panel 20. Control panel 20 is in electrical communication with a controller (not shown) which sends signals to the motors discussed above. The controls on the control panel are configured to be easily used by a user with limited mobility and motor control. The controls preferably include a switch that allows the user to actuate the conveyor belt system, a switch that allows the user to actuate the shooter wheel system, and a knob that allows the user to adjust the speed of the shooter wheel.

In use, the user first turns on the conveyor belt system just long enough to pick the ball up off the floor and feed it into the frame, and then shuts off the conveyor belt system, at which point the slight interference fit between the ball and frame/belt will hold the ball in the desired vertical position. The user then drives his or her wheelchair to the desired shooting position relative to the basket. When in position, the user turns on the switch to actuate the shooter wheel system, uses the knob to adjust the shooter wheel speed, and finally re-actuates the conveyor belt system to feed the ball into contact with the shooter wheel. The device will then eject the ball from the shooter track towards the basket. This sequence of steps provides the user with the satisfaction of utilizing skill in shooting the basket despite the user's limited mobility and motor control.

OTHER EMBODIMENTS

A number of embodiments have been described. Nevertheless, it will be understood that various modifications may be made without departing from the spirit and scope of the disclosure.

Figure 6:
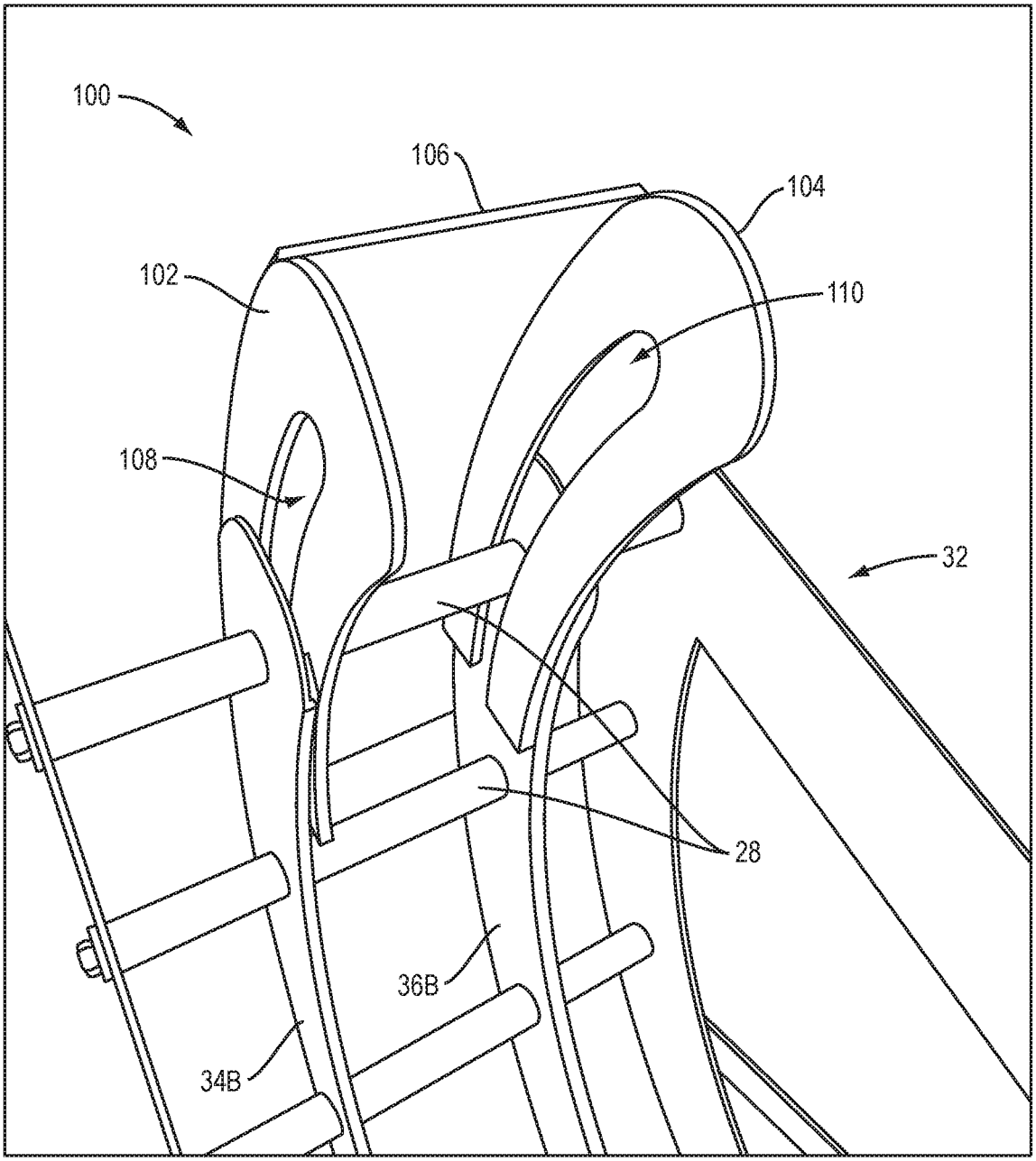
FIG. 6 is a diagrammatic view of a portion of the shooter track of the device of FIG. 1, with an attachment added to allow adjustment of the release angle of the ball.

For example, while in the device shown in FIGS. 1-5 the release angle of the device is fixed, in some implementations the device is configured to allow a user to adjust the release angle. For example, as shown in FIG. 6 an attachment 100 can be added to the device. Attachment 100 includes two rail extensions 102, 104 that serve to adjustably increase the length of the inner rails 34B, 36B of the upper shooting section 32. The rail extensions are connected by a connecting member 106 for stability. Rail extensions 102, 104 include arcuate slots 108, 110 through which the rail extensions are slidably mounted on the rods 28, allowing the attachment 100 to slide relative to the upper shooting section 32 in order to lengthen/shorten the arc that determines the release angle of the ball. The movement of the attachment is preferably controlled by an electrical actuator or a motor mounted on the back side of the rails (not shown) to allow adjustment to be accomplished by the user. As the attachment is retracted, the release angle will increase, allowing for closer shots, and conversely as it is extended, the release angle will decrease, allowing for longer shots. In such implementations, an additional actuator (e.g., a switch or dial) is provided on the control panel 20, allowing the user to adjust the position of the attachment relative to the frame, for example between discrete settings like close/middle/far or with continuous variability.

Additionally, while in the implementation described above pressure is applied to the ball during conveying as a result of the spacing between the conveyor belt surface and the guide rails, in some implementations pressure can be applied by spring-loading the conveyor belt such that the conveyor belt surface is biased towards the ball. The springs would allow for tension adjustment to ensure the ball will not slip while in the lower track. Spring-tensioning would also eliminate the need for the positioning roller because it would aid the ball in contacting the shooter wheel. The springs may also be configured to allow vertical adjustment of the bottom of the conveyor belt in order to be able to adjust the distance between the bottom of the conveyor belt and the ground to facilitate picking the ball up.

If desired, the wheels 16 can be configured to allow vertical adjustment of the spacing between the bottom of the conveyor belt (and the adjacent rails) in order to facilitate picking the ball up.

Accordingly, other embodiments are within the scope of the following claims.

What is claimed is:

1. A device comprising:

a frame configured to be mounted on a wheelchair, wherein the frame includes a platform that is configured to be attached via armrest supports of the wheelchair, the frame having a lower transport section and an upper shooting section, a conveyor system disposed in the lower transport section and configured to retrieve a basketball from a basketball court surface on which the wheelchair is positioned, and in cooperation with a track defined by the frame convey the ball vertically within the frame, and a shooter wheel system disposed in the upper shooting section and and configured to receive the ball from the conveyor system and eject the ball upward from the device, wherein the shooter wheel system comprises a shooter wheel that is driven by a motor and a pair of upper guide rails that define a shooter wheel track, the upper guide rails having stationary arcuate contact surfaces that face the shooter wheel, wherein the arcuate contact surfaces of the upper guide rails are configured to contact the basketball such that the basketball is positioned between and in contact with a contact surface of the shooter wheel on one side and the arcuate contact surfaces of the upper guide rails on an opposite side, and wherein the shooter wheel track, in combination with a rotational force applied by the shooter wheel, ejects the basketball upward from the device.

2. The device of claim 1 wherein the track of the conveyor system comprises lower guide rails configured to guide vertical movement of the basketball within the frame.

3. The device of claim 2 wherein the lower guide rails have contact surfaces and the conveyor system further comprises a conveyor belt positioned opposite the lower guide rails such that the ball is interposed between a contact surface of the conveyor belt and the contact surfaces of the lower guide rails during vertical movement.

4. The device of claim 3 wherein the contact surface of the conveyor belt is positioned sufficiently close to the contact surfaces of the lower guide rails so that pressure is applied to the ball by the contact surfaces during vertical movement.

5. The device of claim 3 wherein a lowermost surface of the conveyor belt is positioned about 7.5 to 9.5 inches above a lowermost surface of the lower guide rails.

6. The device of claim 3 further comprising a positioning member configured to deflect an upper region of the conveyor belt toward the lower guide rails to urge the ball upward into engagement with the shooter wheel system.

7. The device of claim 1 wherein the contact surface of the shooter wheel is disposed sufficiently close to the arcuate contact surfaces of the upper guide rails so that the contact surfaces apply pressure to the ball during shooting.

8. The device of claim 1 further comprising a control system in electrical communication with a drive assembly for the conveyor system and a drive assembly for the shooter wheel system.

9. The device of claim 8 wherein the control system includes a user interface configured to allow the user to actuate the conveyor system and the shooter wheel system.

10. The device of claim 1 wherein the arcuate contact surfaces are concave.

11. A device comprising:

a frame configured to be mounted on a wheelchair, wherein the frame includes a platform that is configured to be attached via armrest supports of the wheelchair, the frame having a lower transport section and an upper shooting section, a conveyor system disposed in the lower transport section and configured to retrieve a basketball from a basketball court surface on which the wheelchair is positioned, and in cooperation with a track defined by the frame convey the ball vertically within the frame, and a shooter wheel system mounted on the frame and configured to receive the ball from the conveyor system and eject the ball upward from the device, wherein the conveyor system comprises a conveyor belt positioned opposite the lower guide rails such that the ball is interposed between a contact surface of the conveyor belt and the contact surfaces of the lower guide rails during vertical movement, and lower guide rails configured to guide vertical movement of the ball within the frame, the lower guide rails having contact surfaces that face the conveyor belt, and wherein the contact surface of the conveyor belt is positioned sufficiently close to the contact surfaces of the lower guide rails so that sufficient pressure is applied to the ball by the contact surfaces during vertical movement to allow the basketball to be picked up from the basketball court surface and conveyed upward by the conveyor belt, and to allow the basketball to be held in a fixed vertical position within the frame when the conveyor belt is turned off by a user.

12. The device of claim 11 wherein the lower guide rails include arcuate surfaces configured to initiate contact between the basketball and a lowermost surface of the conveyor belt to guide the basketball from the basketball court surface into contact with the conveyor belt.

13. A method of shooting a basketball from a wheelchair sing the device of claim 11, the method comprising:

mounting on a wheelchair the device of claim 11 configured to eject a basketball upward, allowing a user with limited use of his or her arms to shoot a basket from a seated position in the wheelchair;

actuating the conveyor belt of the device to draw the basketball from a basketball court surface into the frame;

move the basketball vertically upward within the frame, with the basketball pressed between the conveyor belt and the lower guide rails facing the conveyor belt; and actuating the shooter wheel system of the device to eject the basketball from the frame in an upward trajectory.

14. The method of claim 13 further comprising, after drawing the basketball into the frame but prior to actuating the shooter wheel, the user turning the conveyor belt off and driving the wheelchair to a shooting position relative to a basket with the basketball held in a fixed vertical position within the frame by pressure between the driven belt and the guide rails.

15. The method of claim 13 wherein the steps of actuating the driven belt and actuating the shooter wheel comprise the user operating switches provided on a control panel that is in electrical communication with a controller.

16. The method of claim 15 wherein the controls include a switch that actuates the driven belt, a switch that actuates the shooter wheel, and a knob that allows the user to control the speed of the shooter wheel.

17. The method of claim 13 further comprising, prior to the step of actuating the driven belt, inflating a tire of the shooter wheel to a pressure of from about 5 to 20 psi.

* * * * *